US006129012A

United States Patent [19]

Dietz et al.

[11] Patent Number: 6,129,012

[45] Date of Patent: Oct. 10, 2000

[54] INK CUPS FOR PAD PRINTING MACHINES

[75] Inventors: Volker Dietz, Batavia; Glenn Poyer, Waukegan; Jeffrey M. Stupar, West Dundee, all of Ill.

[73] Assignee: Illinois Tool Works Inc., Glenview, Ill.

[21] Appl. No.: 09/243,883

[22] Filed: Feb. 3, 1999

[51] Int. Cl.[7] ..... B41F 17/00

[52] U.S. Cl. ..... 101/41; 101/167

[58] Field of Search ..... 101/35, 41, 42, 101/43, 44, 150, 163, 167, 169, 170

[56] References Cited

U.S. PATENT DOCUMENTS

| | | | |
|---|---|---|---|
| 794,213 | 7/1905 | Blaisdell | 101/167 |
| 3,585,932 | 6/1971 | Granger | 101/169 |
| 3,656,431 | 4/1972 | Giori | 101/169 |
| 4,241,691 | 12/1980 | Hopfe et al. | 101/365 |
| 4,557,195 | 12/1985 | Phlipp | 101/163 |
| 4,905,594 | 3/1990 | Phillip et al. | 101/163 |
| 5,095,817 | 3/1992 | Takamura | 101/163 |
| 5,151,386 | 9/1992 | Bottari et al. | 101/163 |
| 5,237,375 | 8/1993 | Michlin et al. | 101/169 |
| 5,237,922 | 8/1993 | Ho | 101/163 |
| 5,272,973 | 12/1993 | Chojnacki | 101/163 |
| 5,320,037 | 6/1994 | Harris | 101/163 |
| 5,363,761 | 11/1994 | Galassi | 101/163 |
| 5,383,398 | 1/1995 | Binnen | 101/41 |
| 5,456,170 | 10/1995 | Bachmann | 101/35 |
| 5,476,040 | 12/1995 | Kleist | 101/163 |
| 5,662,041 | 9/1997 | Kleist | 101/163 |
| 5,664,496 | 9/1997 | Scheuhing et al. | 101/169 |
| 5,694,847 | 12/1997 | Kleist | 101/170 |

*Primary Examiner*—John S. Hilten
*Assistant Examiner*—Amanda B. Sandusky
*Attorney, Agent, or Firm*—Pitney, Hardin, Kipp and Szuch LLP

[57] ABSTRACT

The doctor portion of the ink cup of a pad printing machine is formed of a polymeric composite which has high compressive strength and high resistance to chemicals, notably to printing inks. The polymeric doctoring portion is tapered and defines a narrow distal end surface which circumscribes the open end of the cup for doctoring engagement with an opposed plastic gravure surface. The doctoring portion may be a separate ring element suitably mounted at the open end of the cup body or it may be a unitary part of the cup.

5 Claims, 5 Drawing Sheets

INK CUPS FOR PAD PRINTING MACHINES

FIELD OF THE INVENTION

The present invention is directed to improved ink cups used in pad printing machines.

BACKGROUND OF THE INVENTION

Sealed ink cup pad printing machines comprise an ink cup which is supported in inverted fashion with a sealing and doctoring end surface thereof in abutment with a printing block or "cliche" that is mounted in reciprocating fashion for transferring ink in a predetermined pattern to a printing pad. The ink cup includes an annular surface, which may be an integral part of the cup or, alternatively, a separate ring, that serves as a sliding seal between the ink cup and the cliche and as a doctor blade or "knife" for ensuring that only the engraved portions of the cliche carry ink to the printing pad pick-up site.

U.S. Pat. Nos. 4,557,195 and 4,905,594 disclose examples of prior such machines and their disclosures are incorporated herein by this reference.

To ensure quality printing with pad printers, it is important that the annular doctor blade of the ink cup reliably scrape or wipe from the cliche plate all ink that is not within the engraving recesses. Consistently obtaining the clean wiping action has presented problems. To obtain and maintain a sealing and wiping action, doctor elements typically have been formed of a very hard material, such as carbide, ceramic, high speed steel, or other hard metal, and have been finished to a very accurate planar surface, as by lapping. For example, the aforenoted U.S. Pat. No. 4,557,195 describes the use of hard materials for forming the end contact surfaces of the ink cups, at least in those areas which serve a wiping function. A further suggestion is made therein that it may be possible to use elastic parts made of metal or plastic for the side portions of rectangular cup end surfaces which extend parallel to the direction of displacement and do not have a wiping function, but merely serve the function of sealing aprons in a non-etched area.

Many cliches are made of metal, particularly for high volume reproduction of the same image. However, cliches which have a plastic gravure surface, e.g. of a photosensitive polymer material, have gained wide usage because generally they are much less expensive to produce and to engrave than the cliches which use a metal gravure surface. The plastic gravure surfaces may be provided by using a basic support plate or block, as of metal, with a gravure surface formed by a layer, laminate or coating of a photosensitive polymer, or may constitute an entire plate or block of such a polymer material. However, the plastic gravure surfaces have tended to wear much more rapidly than the metal or metal-surfaced cliches. For this reason, the cliches with plastic gravure surfaces have been used primarily for relatively short production runs.

Ink cups have generally been formed of metals such as aluminum, steel, or plastics. The doctoring portion of the cup is ordinarily constructed of carbide steel. U.S. Pat. No. 5,662,041 discloses an ink cup wherein the doctoring portion is formed of a polymeric material, such as a polymeric composite containing polyaryletherketone and carbon fibers, permeated by a solid lubricant.

The ink cup, the doctoring portion, and by extension, the material(s) of which it is constructed, must exhibit certain physical properties. They must be chemically resistant to components of the ink, notably dibasic esters and aromatic hydrocarbons. They must also be sufficiently strong and stiff in view of the demanding operating environment. Furthermore, the materials used to construct the doctoring portion must be resistant to wear, as the doctoring portion repeatedly wipes the cliche during operation.

SUMMARY OF THE INVENTION

It is an object of this invention to provide an improved ink cup for pad printing machines that is formed of plastic materials.

It is a further object of the invention to provide an ink cup wherein the doctoring portion of the ink cup is formed of plastic material.

It is a further object of the invention to provide a doctoring blade formed of a plastic material which provides the chemical resistance necessary to withstand the adverse effects of exposure to dibasic esters and aromatic hydrocarbons found present in the inks.

It is a further object of the invention to provide a doctoring blade formed of a plastic material which is sufficiently stiff and strong so as to withstand the conditions of the operating environment.

It is a further object of the invention to provide a doctoring blade formed of a plastic material which is sufficiently resistant to wear.

It is another object of this invention to provide ink cups with improved doctor blade surfaces in pad printing machines.

It is another object of this invention to all plastic ink cups wherein both the ink cup and doctoring portion are constructed of plastic materials.

It has been found that the doctoring portion of an ink cup of a pad printing device, can be formed of plastic materials which exhibit the required chemical resistance and stiffness, at a significant cost savings, when compared to cups having metal doctoring portions. That is, the carbide steel ring that is primarily used as the doctoring portion of the cup is very expensive and in fact accounts for most of the costs of construction. Accordingly, an ink cup having a plastic doctoring portion, available at a reduced cost, capable of operating in the same environment as an ink cup with a metal doctoring portion, offers a significant advantage over the prior art cups.

When a plastic doctoring portion is used, the molten plastic material fills the space where the carbide steel ring would otherwise be inserted into the ink cup. Thus, in any polymeric material that is to be used as the doctoring portion must be injection moldable and machinable to tight tolerances.

The doctoring portion preferably is formed of a polymeric composite which has high compressive strength and high resistance to chemicals, notably to printing inks. The polymeric doctoring portion should define a narrow distal end surface which circumscribes the open end of the cup for compressive sliding, sealing and doctoring engagement with an opposed plastic gravure surface. The doctoring portion may be a separate ring element suitably mounted at the open end of the cup body or it may be a unitary part of the cup. It has been found that some wear of the distal end occurs, and that the reliability of obtaining clean doctoring of the gravure surface decreases significantly in current machines when the tip width increases beyond about 0.03 inches. It is beneficial to form this contact portion with a narrow tapered cross section, such as, merely for exemplary purposes, with an initial tip width on the order of 0.015 inches and tapering to approximately 0.021 inches within the range of anticipated wear.

A specific material which is preferred for forming the doctoring portion is a polymer composite of a 65% mineral and glass loaded polyphenylene sulfide, available from the GE Plastics, Pittsfield Mass., under the tradename SUPEC G323. Other suitable materials for the plastic cup include a 60% ceramic loaded nylon 6,6, (available from LNP Engineering Plastics, Inc. Exton Pa., under the designation LSG440), filled polyamides such as PA 6 or PA 6,6, or other polyamides, filled polyesters, such as poly(ethylene terephthalate) or poly(butylene terephthalate), filled or unfilled polyetherketone (PEEK), filled acetal, filled or unfilled polyphenylene oxide, filled or unfilled polyarylimide (PAI), filled or unfilled polyethersulfone (PES) and thermoset materials, such as phenolics or polyesters. These polymers may or may not contain fillers. Suitable fillers include glass, mineral, carbon fiber, wollastonite, mica, and platy talc.

DESCRIPTION OF THE PREFERRED EMBODIMENTS

Figure 1:
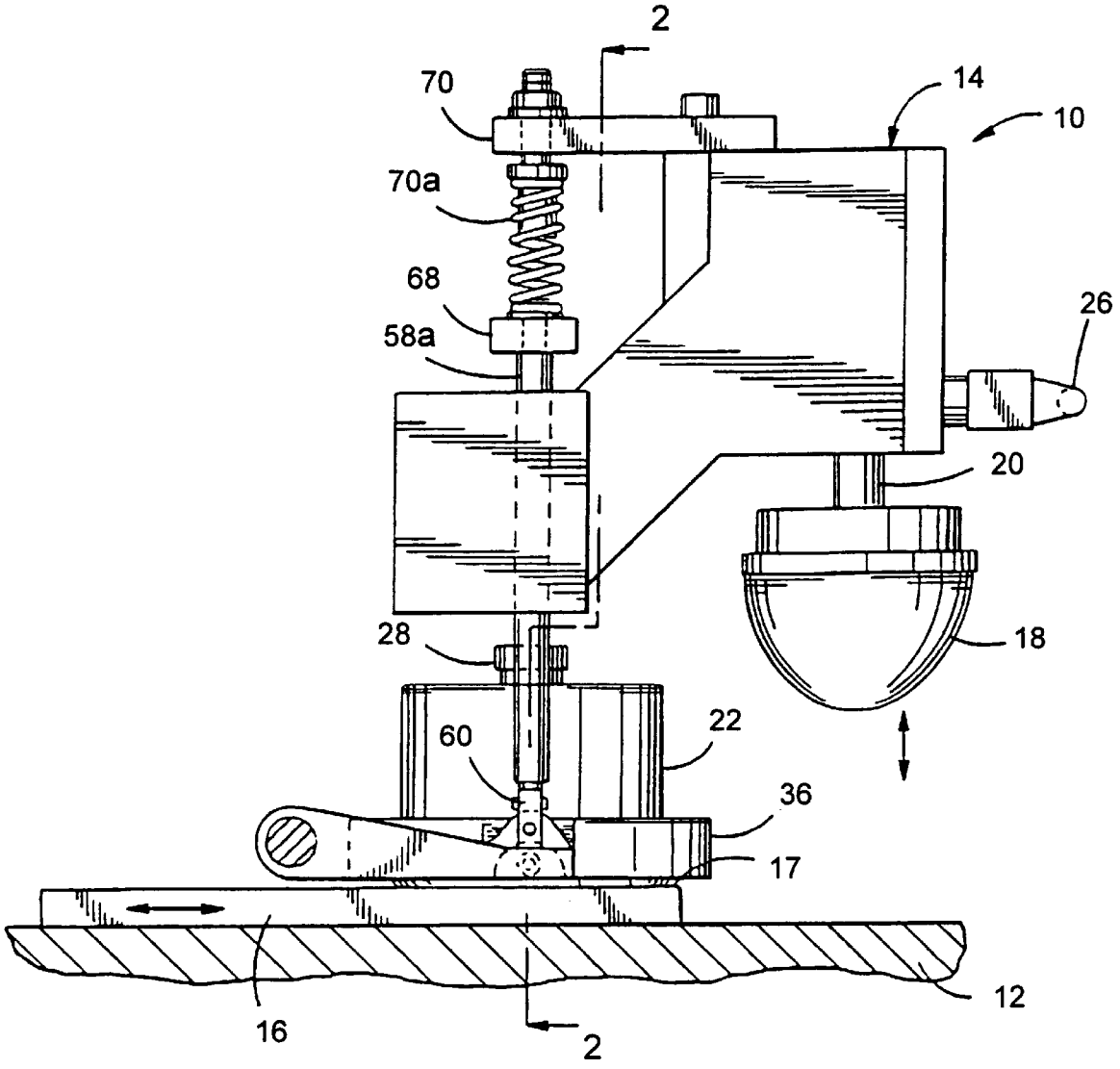
FIG. 1 is a side view of the printer section of a pad printing machine.
Figure 2:
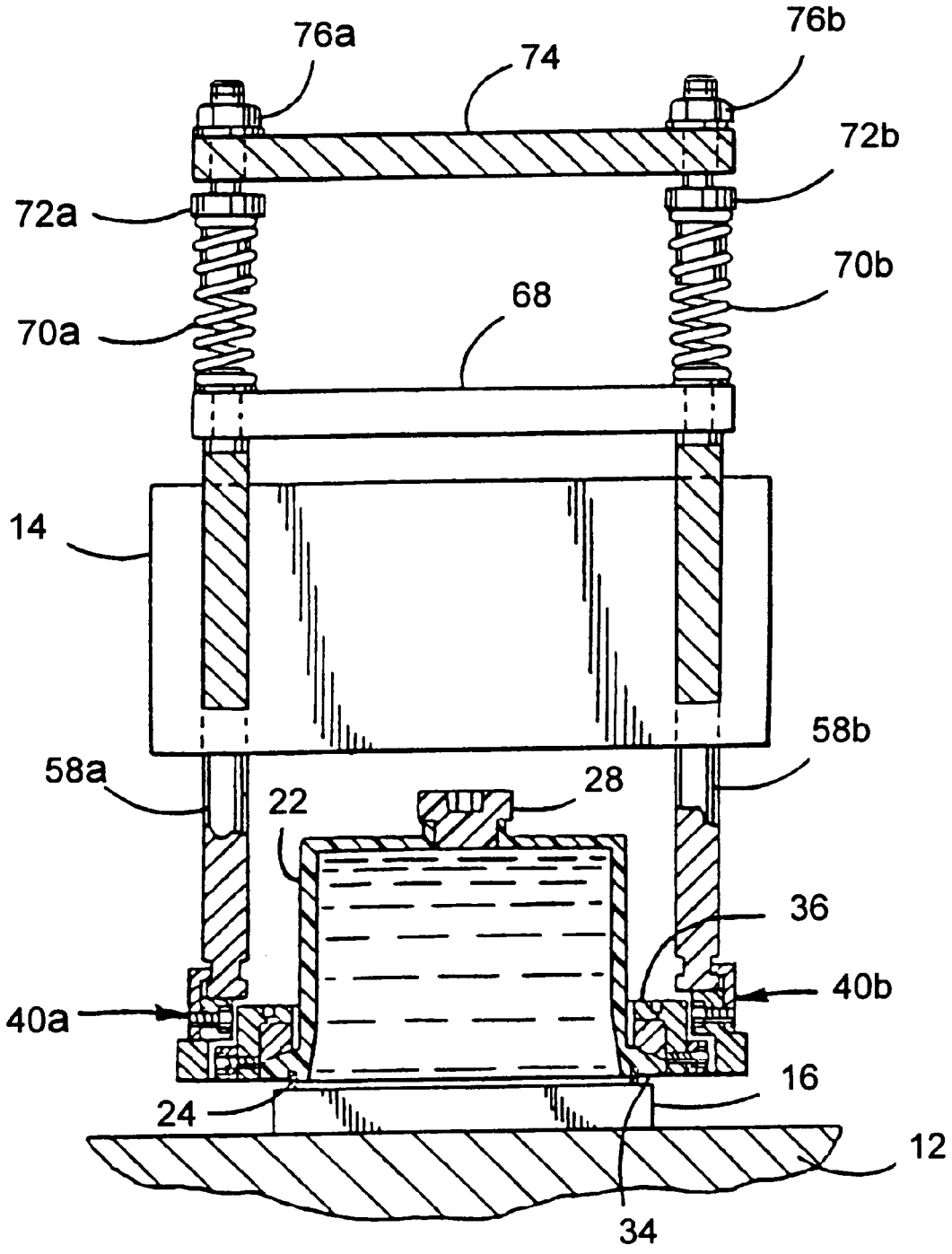
FIG. 2 is a vertical view, partially in section, taken generally along the broken line 2—2 of FIG. 1.
Figure 3:
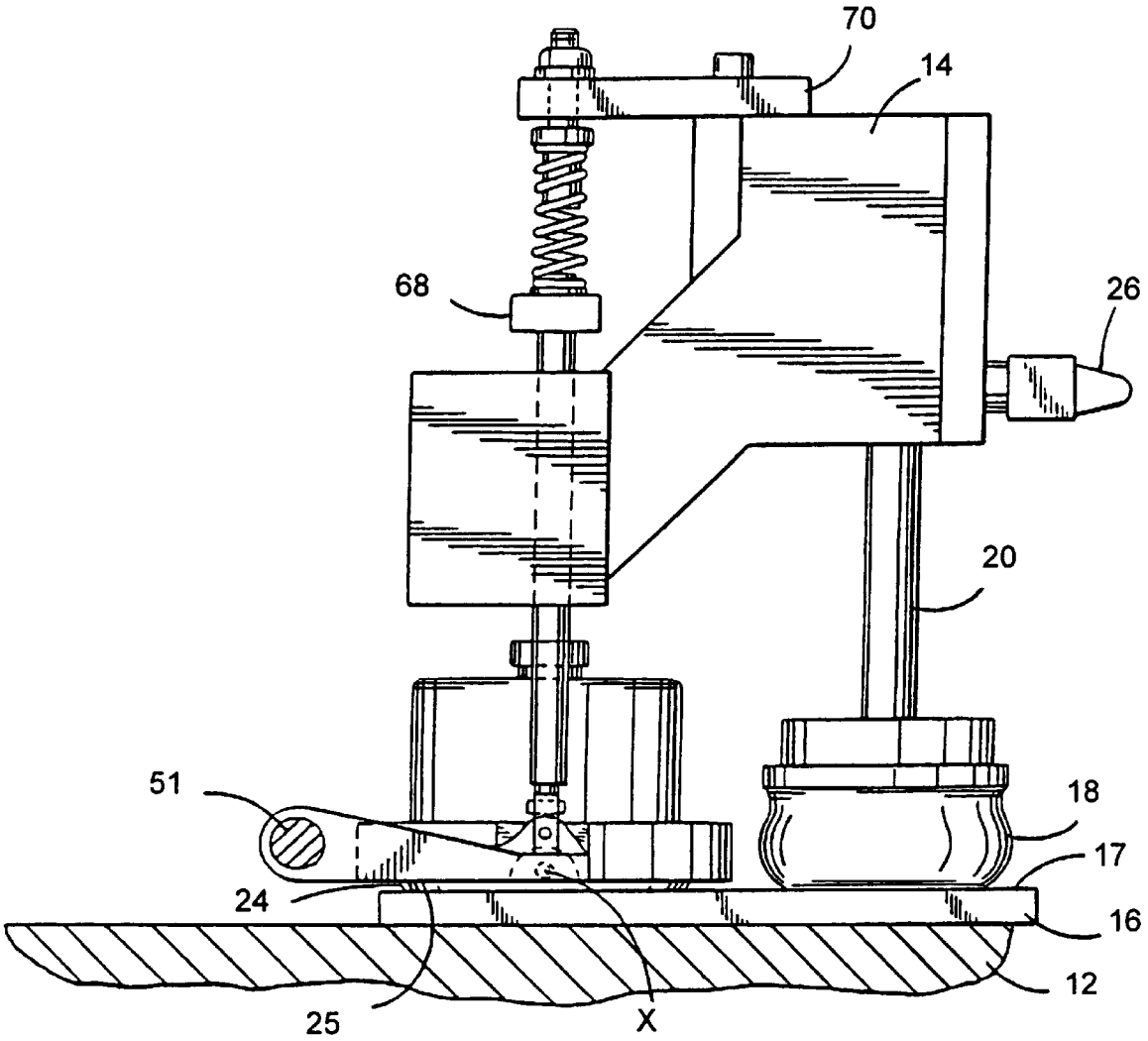
FIG. 3 is a view of the apparatus of FIG. 1 with the cliche and the printing pad advanced to their impression transferring positions.

The drawings illustrate the ink holding and transfer components of a pad type printing machine 10. The machine includes a support frame of which the illustrated portions include a base 12 and an upper frame portion 14 both of which are components of an appropriate frame structure for such machines, as is known in this art. A flat gravure plate 16 is suitably mounted on the plate bed for reciprocation between a retracted inking position as in FIG. 1 and an extended transfer position as seen in FIG. 3. This plate, also commonly known as a cliche, may be of any suitable material, typically being metal, plastic or a combination thereof and normally being photo engraved on its upper gravure surface 17 with the text, logo or other pattern which is to be printed by the operation of the machine 10. In the machine 10 the gravure surface 17 is the upper surface of a non-metallic, preferably plastic layer 16A which carries the engraved image in a known manner; see FIG. 4. Preferably, this is a thin layer of a photoreactive polymer which is applied to the top surface of a printing block body 16B of another material, such as by affixation of a sheet or coating 16A of the photosensitive polymer to a base printing block 16B formed of metal or the like. However, the gravure surface 17 also may be an integral part of a printing block formed of an appropriate polymer material.

Suitable polymer gravure materials and commercial products for providing the plastic gravure surface 17 are known. For example, they include plates and laminates made of the various so called photosensitive or photoreactive polymers currently available in the market, such as various polyamide photopolymer materials. Further, they may be of the water wash types, such as the "nyloprint" and "nylograv" plates available from BASF Lacke+Farben AG of Stuttgart, Germany, or alcohol wash types, such as of the "ST-52" material available from the same company.

A transfer pad 18 of appropriate configuration is mounted on a support rod 20 for suitable vertical reciprocating motion. With the cliche 16 extended, the pad 18 is pressed against the engraved area of the cliche as in FIG. 3 to receive the ink pattern therefrom and then is retracted upward. While the cliche subsequently is retracted as in FIG. 1 for re-inking, the pad 18 is advanced against a recipient object to transfer the ink pattern thereto, in a known manner by any appropriate coordinated driving mechanism.

An ink cup 22 is mounted over the cliche to serve as a supply reservoir for the printing ink. The cup has an open bottom for free access of the ink to the upper surface 17 of the cliche and has a doctor blade or "knife" ring portion 24 around its open lower end. This blade 24 must be maintained in continuous and constant contact with the adjacent surface 17 of the cliche 16 at all times to form a seal for retaining the ink supply in the cup 22 and to scrape the surface 17 clean of all ink thereon as the cliche is advanced from the loading position of FIG. 1 to the transfer position of FIG. 3, except only for the ink in the depressions engraved or otherwise formed in the upper surface 17 to define the print pattern. The blade portion 24 may be part of the cup itself or a separate element suitably attached to the lower end of the cup. In either event, the doctor blade presents a very narrow distal end surface 25 against the cliche and is subject to continual wiping action against the cliche as the cliche is reciprocated. The blade ring 24 is formed of a plastic which has high compressive strength, thereby providing a firm lower doctoring edge portion of plastic. The blade ring must also exhibit suitable chemical resistance to the ingredients of the ink, such as dibasic esters.

The contact end surface 25 of the knife ring and the upper surface 17 of the cliche should be accurately formed and maintained in suitable compressive abutting engagement with one another throughout the length of the knife blade, i.e. throughout the circumference of the ring. Slight deviations of either surface from the other, on the order of a few microns, or even variations in the compressive force between the two surfaces along different portions of the circumference of the ring, can cause leakage of the ink, or leave a film of ink in undesired areas of the exposed portions of the cliche (sometimes referred to as "fogging") and/or cause scratches or other undesirable wear patterns on the cliche and/or the doctor ring which can adversely affect the useful life of the relatively expensive cliches and rings. Thus, it is highly desirable that intimate but uniform pressure contact be maintained between the ring and the gravure surface of the cliche.

An adjustment handle 26 is provided at the front of the apparatus to adjust the effective length of the support rod. A removable filler plug 28 is provided in the upper end of the ink cup. The cup 22 also includes an annular flange 34, such as is typically provided adjacent the lower open end of such cups.

The hold down mechanism for maintaining the cup in position with its doctor blade 24 in desirable continuous engagement with the cliche 16 includes: A thrust collar 36 which fits in superposed relationship over the flange 34; the collar 36 is pivotably mounted at diametrically opposite sides by a pair of interconnection mechanisms 40*a* and 40*b* for pivotal movement about an axis "X" which is parallel to the surface 17 and perpendicular to the reciprocating path of the cliche; and, the bearing structure for applying external downward forces to the thrust collar 36 and thus to the cup 22 is of a design to assure that these forces are applied to the collar at points spaced forwardly and rearwardly of the transverse pivot axis X (see FIG. 3) and not directly on the pivot axis, to provide a restraining or stiffening action which resists fore-and-aft tilting tendencies of the cup as the cliche reciprocates.

Down-pressure forces are applied to the cup support components by a pair of pressure rods 58*a*, 58*b* which are disposed in parallel, upright arrangement thereover. Slight vertical relative movements are allowed between the two pressure rods and hence between the two sides of the collar 36 to allow tilting adjustment of the collar and hence of the cup 22 transversely of the center longitudinal horizontal axis which is generally parallel to the direction of reciprocation of the cliche and orthogonal to the aforementioned X axis. To this end the pressure rods 58*a* and 58*b* are mounted for vertical movement in the machine frame portion 14. A pressure plate 68 is mounted on the upper ends of these two rods 58*a*, 58*b*. A pair of compression springs 70*a*, 70*b* engage the upper ends of the respective rods 58*a*, 58*b* and have their upper ends confined by respective adjustable tension screw mechanisms 72*a*, 72*b* which are supported in an upper spring plate 74 that is affixed to the machine frame 14. The compressive force applied by each spring 70*a*, 70*b* can be adjusted, such as by threaded adjustment of the respective mounting nuts shown at 76*a*, 76*b*.

In the preferred embodiment, the cup 22 is formed of a hard plastic material which provides suitable chemical resistance to withstand the ingredients of the ink, such as poly(butylene terephthalate), or any of the other materials described in this patent specification. The material could be the UHMW PE product TIVAR® 1000. However, the benefits of this invention are realizable with ink cups formed of other materials, such as aluminum, steel or other metals.

Figure 4:
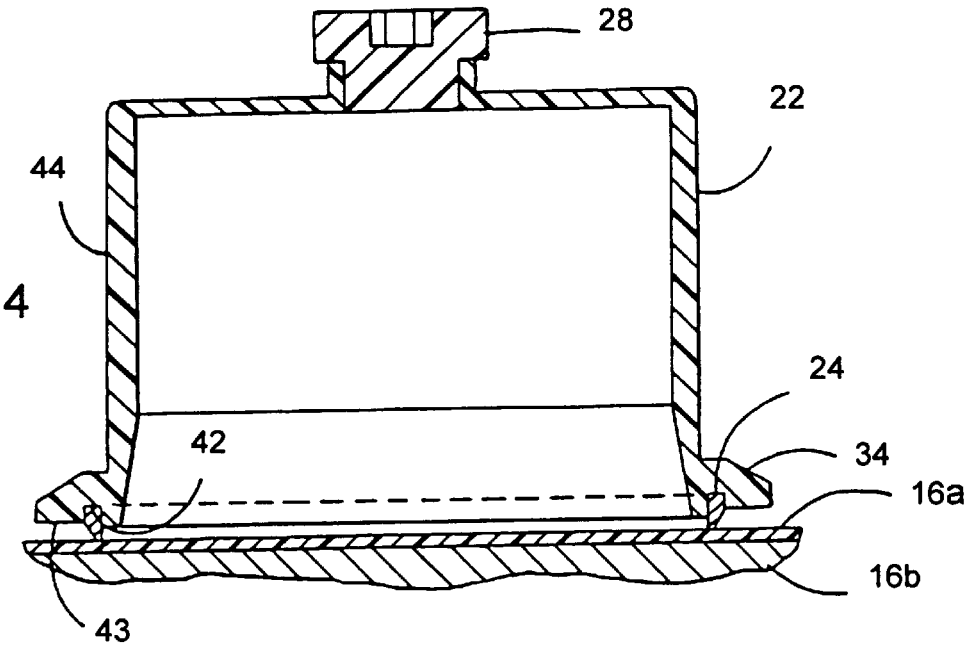
FIG. 4 is an enlarged diametrical cross sectional view of an ink cup and abutting cliche as in FIG. 2.
Figure 5:
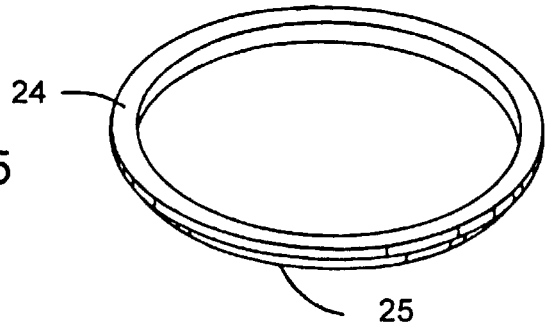
FIG. 5 is an enlarged perspective view of a doctor ring as in FIG. 4.
Figure 6:
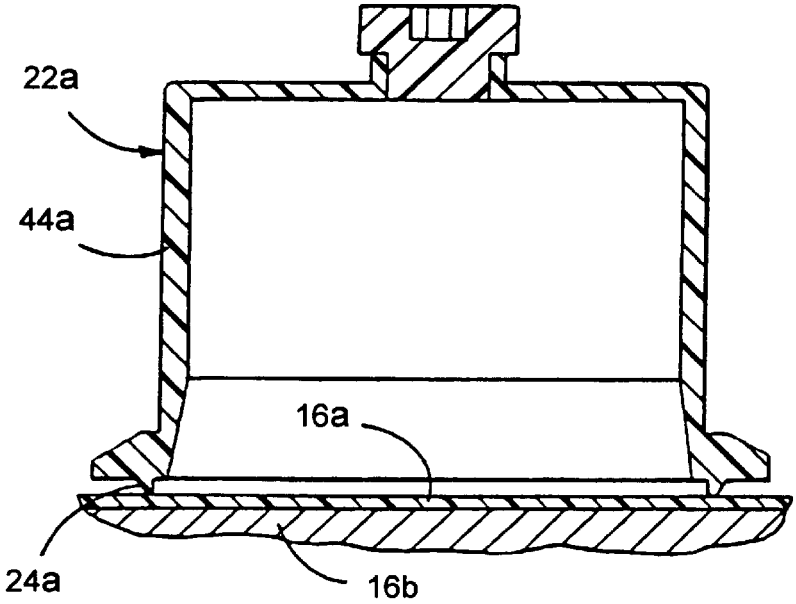
FIG. 6 is a view similar to FIG. 4 illustrating another embodiment employing teachings of this invention, namely in an ink cup wherein the doctor ring portion is formed integral with the main body of the cup.

Turning now particularly to FIGS. 4–6, the doctor ring portion 24 of the cup 22 is a separate continuous ring which is force-fit into a groove 42 in the distal end face 43 of the cup body 44. The ring includes a generally rectangular base portion 45 which fits into the groove 42 and a tapered end portion 46 which narrows from the base portion to a narrow distal edge or end surface 25 that constitutes the doctoring surface. The ring 24, when installed in the cup body 44 as in FIG. 4, defines and circumscribes the open end of the ink cup 22. The ring 24 is formed of a polymeric composite which has high compressive strength, e.g., greater then about 30,000 psi at temperatures below about 300° F., and up to about 21,750 psi below 100° F., i.e. at ambient room temperatures. The polymeric composite also has high chemical resistance to printing inks, while also having good wear resistance, while continually renewing its surface. In one instance, the inventors found that the tip width degraded only slightly, from an initial width of 0.015" to 0.021". That is, the distal doctoring end surface is slow to wear away while serving the doctoring function against an abutting and reciprocating plastic gravure surface, while the edge surface of the blade renews itself continually. It appears that the provision of a narrow end surface is important to obtaining clean consistent wiping or "doctoring" to remove from the surface 17 all ink except that which is in the engraved grooves which define the desired print pattern, with the down-forces normally applied to the cups 22 in the described types of machines.

FIG. 6 illustrates an alternative embodiment of an ink cup 22A in which a doctoring ring portion 24A is integral with the cup body 44A. Such a cup may be provided by molding the cup and ring as one unitary structure or by machining to its final form from a molded or cast blank of appropriate materials as described in this patent specification with respect to the ring portion 24. Alternatively, an integral unit 24A could be fabricated by fusion molding or "welding", using such materials for the doctor ring portion and a different but compatible material for the cup body portion.

The doctoring portion 24 may be fabricated of a polymer composite of a 65% mineral and glass loaded polyphenylene sulfide, available from the GE Plastics, Pittsfield Mass., under the tradename SUPEC G323. Other suitable materials include a 60% ceramic loaded nylon 6,6, (available from LNP Engineering Plastics, Inc. Exton Pa., under the designation LSG440), filled polyamides, such as PA 6 or PA 6,6, or other polyamides, filled polyesters, such as poly(ethylene terephthalate) or poly(butylene terephthalate), filled or unfilled polyetherketone (PEEK), filled acetal, filled or unfilled polyphenylene oxide, filled or unfilled polyarylimide (PAI), filled or unfilled polyethersulfone (PES) and thermoset materials, such as phenolic or polyesters. These polymers may or may not contain fillers. Suitable fillers include glass, mineral, carbon fiber, wollastonite, mica, and platy talc. Depending on the polymeric material that is used, the filler may actually provide reinforcement, improving the strength of the composite relative to the polymer material when it does not contain the reinforcing material.

As one particular example, circular rings 24 have been machined from cylinders of the aforenoted material. Such rings had an outside diameter of 65 mm and an inside diameter of 60 mm, resulting in a ring width (measured radially of the ring) of 2.5 mm across the base portion 45, a total axial depth of the ring of about 6 mm, a depth of the rectangular base portion 45 of about 2 mm, a depth of the tapered portion 46 of about 4 mm, and an initial radial width of the end surface 25 of about 0.05 mm. These rings have functioned very well until the width of the contact surface increased to the point that "fogging" began to appear on the gravure surface, apparently due to hydroplaning rather than clean wiping engagement by the end surface. With these particular rings, operated with downpressure forces typical for such machines, such fogging tended to occur when the end surface 25 wore to a radial width of about 0.6 mm, having an initial width of 0.3 mm.

The initial sealing and wiping action of doctoring portions as described herein improve during initial use, apparently due to a self-lapping action against the abutting and reciprocating plastic gravure surface. It has been found that rotating the cup 22 periodically to vary its rotational position relative to the direction of reciprocation of the cliche, e.g., following each few thousand print cycles, helps assure uniform wear of the doctoring portion and the gravure surface while maintaining the sealing and clean wiping action on the gravure surface.

Rings as described herein have provided consistent clean doctoring operation of plastic gravure surfaces over greatly extended functional lives of the plastic images, i.e., providing substantial increases in the number of useful print cycles obtained with each plastic gravure plate as compared to use hard metal doctor rings on gravure plates made of the same plastic materials.

Figure 7:
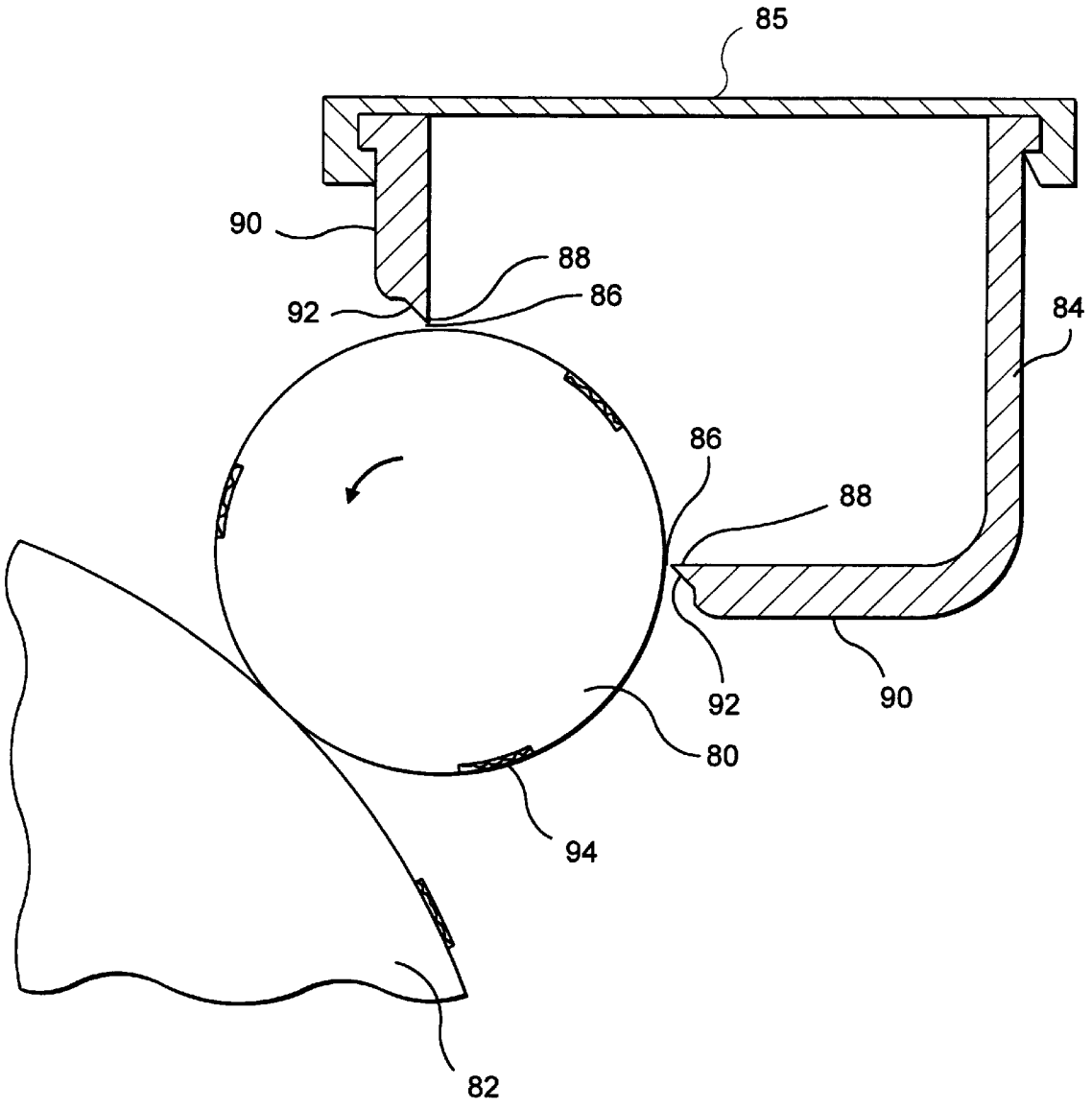
FIG. 7 is a cross-sectional view of an alternative embodiment of the present invention.

FIG. 7 shows an alternative embodiment wherein the cliche drum 80 and transfer pad 82 are of cylindrical shape. The ink reservoir 84 with lid 85 is dimensioned with an opening 86 into which the cliche drum is fitted against the edges 88 of the opening. Doctor blades 90 having doctoring portions 92 are in abutment with the cliche drum 80 and the edges of the reservoir 88. The doctoring portions 92 are tapered and perform the doctoring function against the abutting and rotating transfer pad 82 having gravure surface 94. The narrow end surface of the doctoring portions 92 provides a clean, consistent wiping or doctoring which removes all ink from the surface of the cliche drum 80 except that which is in the engraved grooves of the cliche drum 80.

EXAMPLE

An ink cup and doctoring portion were molded out of a 65% mineral and glass loaded polyphenylene sulfide, available from the GE Plastics, Pittsfield Mass., under the tradename SUPEC G323. During molding, the carbide steel doctoring portion insert was not used. The polymeric composite filled the space where the insert would have been, thereby forming the doctoring portion in the shape of a ring. The ring edge was then machine to specific dimensions.

The ink cup was tested for ink doctoring performance. It was found to deliver ink to a steel cliche for over 495,000 cycles. In addition the ink cup was tested to see how it delivered ink to a polymeric etched plate and was found to deliver for over 262,000 cycles before the polymeric plate wore out. It was noted that in each instance, the ink cup formed of the PPS composite exhibited good chemical resistance to the components of pad printing inks.

We claim:

1. A doctoring portion for an ink cup for a pad printing machine, said doctoring portion being fixed at an open end of the ink cup, said doctoring portion having a narrow distal end surface which circumscribes said open end and is of a configuration for sliding, sealing and doctoring engagement with an opposed gravure surface, said doctoring portion being formed of a polymer exhibiting stiffness, compressive strength, wear resistance, and chemical resistance, the polymer selected from the group consisting of polyphenylene sulfide, polyamides, polyesters, acetals, polyphenylene oxide, polyarylimide, polyethersulfone and phenolic thermosets and polyester thermosets wherein the doctoring portion is formed of an injection molded, filled or unfilled polymer.

2. The doctoring portion of claim 1 wherein the polymer is a polymer composite of a 60% ceramic loaded nylon 6,6.

3. The ink cup of claim 1 wherein the doctoring portion is formed of a polymer composite of a 65% mineral and glass loaded polyphenylene sulfide.

4. The ink cup of claim 1 wherein the doctoring portion is formed of a polymer composite of a 60% ceramic loaded nylon 6,6.

5. A doctoring portion for an ink cup for a pad printing machine, said doctoring portion being fixed at an open end of the ink cup, said doctoring portion having a narrow distal end surface which circumscribes said open end and is of a configuration for sliding, sealing and doctoring engagement with an opposed gravure surface, said doctoring portion being formed of a polymer exhibiting stiffness, compressive strength, wear resistance, and chemical resistance, wherein the polymer is selected from the group consisting of a polymer composite of 60% ceramic loaded nylon 6,6 and a polymer composite of a 65% mineral and glass loaded polyphenylene sulfide.

* * * * *